United States Patent [19]

Waltke

[11] Patent Number: 4,890,756

[45] Date of Patent: Jan. 2, 1990

[54] CYLINDRICAL TANK WITH FLARED UPPER END

[75] Inventor: David L. Waltke, Beatrice, Nebr.

[73] Assignee: Hoover Group, Inc., Roswell, Ga.

[21] Appl. No.: 232,383

[22] Filed: Aug. 15, 1988

[51] Int. Cl.[4] ..... B65D 88/08

[52] U.S. Cl. ..... 220/66; 220/5 R; 220/70; 220/74; 220/320

[58] Field of Search ..... 220/5 R, 66, 69, 70, 220/71, 72, 74, 320

[56] References Cited

U.S. PATENT DOCUMENTS

| | | | |
|---|---|---|---|
| 1,969,120 | 8/1934 | Coakley | 220/320 X |
| 2,643,044 | 6/1953 | Sundholm | 220/69 X |
| 2,686,610 | 8/1954 | Sharpnack | 220/5 R |
| 3,204,811 | 9/1965 | Fine | 220/320 |
| 3,437,254 | 4/1969 | Bergstrom | 220/70 X |
| 3,696,962 | 10/1972 | Fehres et al. | 220/72 X |
| 3,889,839 | 6/1975 | Simon et al. | 220/66 X |
| 3,927,790 | 12/1975 | Chase et al. | 220/5 R X |
| 3,955,705 | 5/1976 | Dubois et al. | 220/71 X |
| 3,987,926 | 10/1976 | Yavorsky | 220/74 X |
| 4,018,468 | 4/1977 | Lundquist | 220/71 X |
| 4,201,306 | 5/1980 | DuBois | 220/5 R |
| 4,228,911 | 10/1980 | Hammes | 220/74 X |
| 4,257,527 | 3/1981 | Snyder | 220/74 X |
| 4,709,833 | 12/1987 | Granberg et al. | 220/72 X |

FOREIGN PATENT DOCUMENTS

| | | | |
|---|---|---|---|
| 2017630 | 10/1979 | United Kingdom | 220/66 |

*Primary Examiner*—Gerald A. Michalsky

*Attorney, Agent, or Firm*—Harness, Dickey & Pierce

[57] ABSTRACT

A container for storing and transporting liquids is disclosed having features to protect the tank from damage which may result in contamination or leaking of the contents. The tank lid has upward projections in its cover member to protect an access opening in the cover member and its closure plug. A lifting ring used by fork lifts to lift the tank extends outward from the tank body and also protects the cover member outer periphery and upper end of the tank should the tank be knocked over.

2 Claims, 1 Drawing Sheet

CYLINDRICAL TANK WITH FLARED UPPER END

BACKGROUND AND SUMMARY OF THE INVENTION

This invention relates to containers for the storage and transportation of liquids in bulk and more particular to a tank incorporating features to reduce the likelihood of damage to the tank which could result in contamination of the liquid contents.

Numerous liquids are transported and/or stored in bulk containers. These liquids often must be protected from contamination and must be placed in a container which will not leak. Containers, in addition to providing secure seals, must also be easily handled by conventional equipment such as fork trucks.

Accordingly, it is an object of this invention to provide a container for liquids which is protected from damage to the container seals to reduce the likelihood of contamination or leaking of the contents.

It is a further object of this invention to provide a container which is easily handled by a fork truck.

It is an advantage of the tank of this invention that as a result of features to reduce tank damage, the useful life of the tank is increased thereby reducing the user's cost.

The tank of this invention provides a convenient means for storing or transporting liquids in bulk while reducing the likelihood of contamination or leaking of the contents. For strength and durability, the tank of this invention is constructed of steel and preferably, of stainless steel. The tank capacity is typically 55 gallons but the invention is not limited to tanks of this size.

The tank of this invention comprises a hollow tubular body at its lower end and open at its upper end through which the tank body is filled and discharged. An extension projects radially outwardly and upwardly from the upper end of the tubular body. A circular rod at the periphery of the extension forms an annular rim. A cover member or lid closes the upper end of the tank and includes a rim section shaped to nest on the annular rim. The cover member includes a small opening which can be used to access the interior of the tank. This opening is closed by a conventional plug. Upward projections in the cover member surrounding the access opening and plug protect the plug from damage if the tank is knocked over. The projections can also function to deflect fork lift tines and thus protect the plug from damage.

To provide a convenient means to lift the tank, a lift ring extends radially outwardly from the upper end of the tubular body. The lift ring has a generally horizontal lower surface for lifting by a fork truck and extends outward beyond the annular rim such that the lift ring protects the cover member and annular rim if the tank is knocked over.

As a result of the features to prevent damage to the cover member, the liquid contents are less likely to be contaminated or to leak.

Further objects, features and advantages of the invention will become apparent from a consideration of the following description and the appended claims when taken with the following drawings.

DETAILED DESCRIPTION OF THE DRAWINGS

Figure 1:
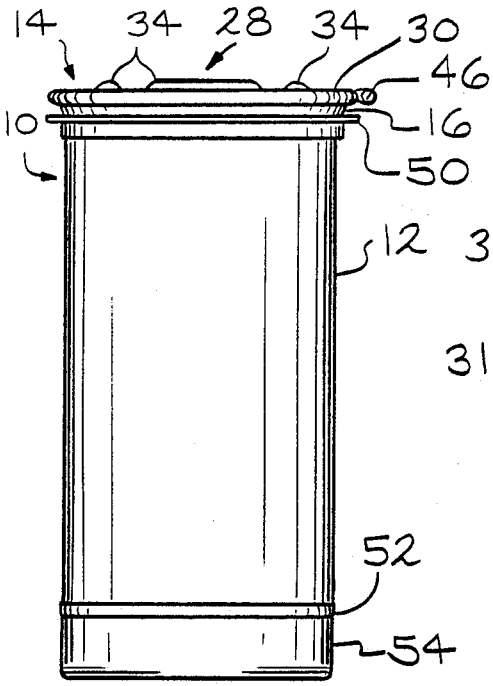
FIG. 1 is a side elevation view of the tank of this invention.
Figure 2:
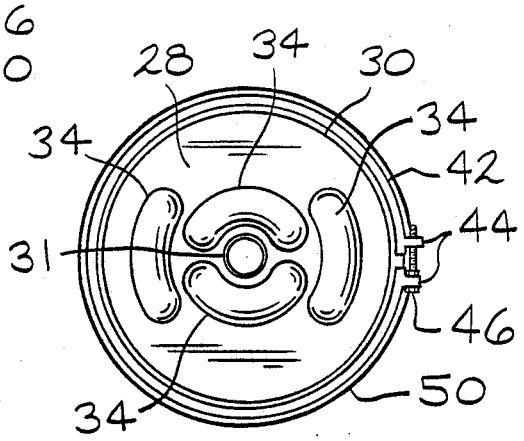
FIG. 2 is a top view of the tank of this invention.
Figure 3:
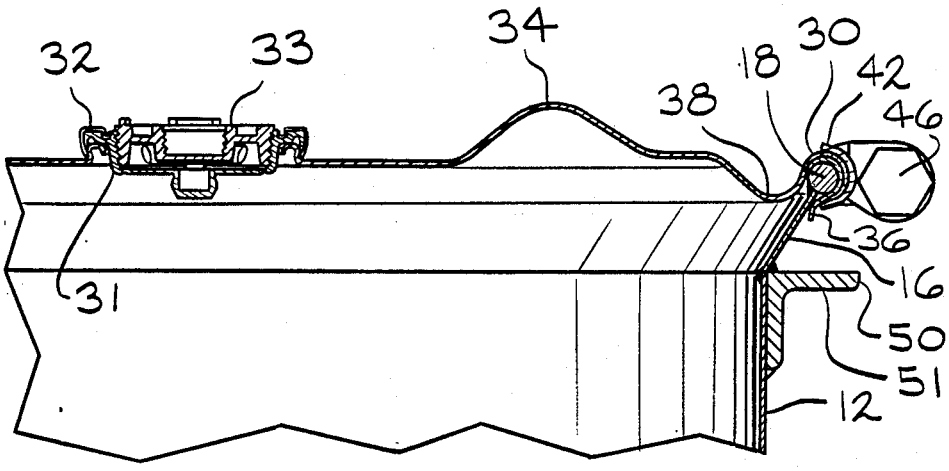
FIG. 3 is an enlarged fragmentary sectional view of an upper portion of the tank.

The cylindrical tank of this invention is shown in FIG. 1 generally at 10. The tank includes a tubular container body 12 having an upper end 14. The container body 12 is filled and discharged through its upper end. Extending downward below the tank bottom 52 is an annular skirt member 54. The tank bottom 52 can be flat or convex outward to form a dished bottom construction within the skirt 54.

Projecting upwardly and outwardly from the upper end 14 of tubular body 12 is an extension 16. The extension 16 is generally inverted frusto-conical in shape. An annular rim member 18 comprised of a circular rod is mounted to the periphery of extension 16.

the tank 10 is closed at the upper end by a circular cover member 28. Cover member 28 includes a circumferential rim section 30 about its periphery which is of a shape to nest on the annular rim member 18 to seal the tank. The annular depression 38 in the cover member 28 adjacent to rim section 30 provides for an increased contact area of the cover member 38 against annular rim 18 to seal the tank. A gasket 36 can be placed between the annular rim member 18 and the circumferential rim section 30 to ensure a leak proof closure for the tank 10.

The cover member 28 includes an access opening 31 which can also be used to fill or empty tank 10. An annular retainer is secured around the opening 31 which has a threaded inner diameter. A conventional plug 33 is screwed into the retainer 32 to close and seal the opening 31.

Surrounding the opening 31 and plug 33 are four raised projections 34 in the cover member 28. Projections 34 extend upward from the surface of the cover member 28 a greater distance than does the plug 33. Projections 34 are provided to protect the plug from damage should the tank be overturned and also to deflect fork lift tines. The protection of the plug 33 helps ensure that the tank contents will not become contaminated during storage or transit by a damaged tank seal.

The cover member 28 is secured to the drum by a clamp ring 42 which is positioned on and substantially encircles the rim member 18 and rim section 30. Clamp ring 42 includes lugs 44 at each end thereof which are held together by a bolt 46 to secure the cover member 28 to the tank 10.

An annular lifting ring 50 is attached to the tubular body 12 at its upper end adjacent to the extension 16. Ring 50 extends radially outwardly from body 12 and defines a generally horizontal lower surface 51. Tank 10 can be lifted by a fork lift having tines spaced to engage the lower surface 51 of ring 50.

Ring 50 is also used to protect the cover member 28 and annular rim 18 in the event the tank falls over onto its side. The ring 50 extends radially outward further than the cover member and clamp ring. Only the lugs 44 and bolt 46 extend beyond the lifting ring 50. If the tank is tipped over onto its side, the lifting ring will receive the impact loads as opposed to the cover member rim section 30 and annular rim 18.

it can be seen from the above that the container 10 is useful for storing or transporting a variety of liquids. Once sealed in the drum, the drum can be conveniently moved by use of a fork lift engaging the lifting ring 50.

In addition, the sealed openings into the tank are protected from damage in the event the tank falls over. By protecting these components from damage, the tank seals are less likely to sustain damage which could cause contamination or leaking of the liquid contents. Furthermore, by reducing the likelihood of damage to the tank, the useful life of the tank is increased. This lowers the cost to the user as tanks need to be replaced less often.

It is to be understood that the invention is not limited to the exact construction or method illustrated and described above, but that various changes and modifications may be made without departing from the spirit and scope of the invention as defined in the following claims.

What is claimed is:

1. An upright generally cylindrical tank for transporting and storing liquids comprising a tubular container body having an upper end through which said container body is filled and discharged, an upward and outwardly projecting extension on said upper end of said container body of generally inverted frusto-conical shape, said extension terminating at the upper end thereof in an annular rim member of circular rod shape secured to said extension, a cover member having a circumferential rim section shaped to nest and engage said rim member so that it extends downwardly and substantially circumferentially engages the radially outer side of said rod shape rim member, an annular clamp ring positioned in a nested relation on and substantially encircling the radially outer side of said nested rim member and said rim section so as to releasably clamp and further secure said cover member on said extension, a lifting ring positioned and secured at the juncture of said body and said extension such that said lifting ring will allow the stable lifting of said tank regardless of the amount of liquid therein, said lifting ring extending radially outwardly from said tubular container body a greater distance than does said upwardly and outwardly projecting extension such that said lifting ring will receive impact loads in the event said tank falls over onto its side.

2. An upright generally cylindrical tank for transporting and storing liquids comprising:

a tubular container body having an upper end through which said container body is filled and discharged;

an upwardly and outwardly projecting extension on said upper end of said container body of generally inverted frusto-conical shape, said extension terminating at the upper end thereof in an annular rim member of circular rod shape secured to said extension;

a cover member having a circumferential rim section shaped to nest on and engage said rim member so that it extends downwardly on the radially outer side of said rod shape rim member and substantially circumferentially engages said rod shaped rim member;

an annular clamp ring positioned on and substantially encircling said nested rim member and rim section so as to releasably clamp said cover member on said extension; and a lifting ring secured to said body at the juncture thereof with said extension, said lifting ring extending radially outwardly a greater distance than said extension, said lifting ring allowing the stable lifting of the tank regardless of the amount of liquid therewithin.

* * * * *